US007703232B1

(12) United States Patent
Johns

(10) Patent No.: US 7,703,232 B1
(45) Date of Patent: Apr. 27, 2010

(54) 1911 HANDGUN BUSHING TOOL

(75) Inventor: Jeffrey Bryan Johns, 2969 Moose Ridge Dr., Reno, NV (US) 89523

(73) Assignee: Jeffrey Bryan Johns, Reno, NV (US)

( * ) Notice: Subject to any disclaimer, the term of this patent is extended or adjusted under 35 U.S.C. 154(b) by 348 days.

(21) Appl. No.: 11/983,705

(22) Filed: Nov. 9, 2007

Related U.S. Application Data

(60) Provisional application No. 60/858,467, filed on Nov. 13, 2006.

(51) Int. Cl.
*F41A 99/00* (2006.01)

(52) U.S. Cl. ..... 42/108

(58) Field of Classification Search ..... 42/106, 42/108, 90

See application file for complete search history.

(56) References Cited

U.S. PATENT DOCUMENTS 4,901,411 A * 2/1990 Chestnut et al. ..... 42/108
D348,503 S * 7/1994 Claveau ..... D22/108
5,417,003 A * 5/1995 Claveau ..... 42/90
D407,958 S * 4/1999 Royse, III ..... D8/16
6,904,634 B2 * 6/2005 Smith ..... 7/128
7,174,667 B2 * 2/2007 Connal ..... 42/108
D564,316 S * 3/2008 Elkaim ..... D8/17
7,401,432 B2 * 7/2008 Perry ..... 42/108

* cited by examiner

*Primary Examiner*—Michael Carone
*Assistant Examiner*—Reginald Tillman, Jr.

(57) ABSTRACT

A handgun bushing tool to facilitate the safe removal and replacement of a barrel bushing on a handgun such as a Model 1911, 1911-A1, 2011 type semiautomatic pistol using a single stack or staggered double-column magazine and having a barrel that requires a bushing and recoil spring plug to secure it. The tool has a handle with an aperture conforming to the shape of a barrel bushing; a hole conforming to the shape of a recoil spring plug and a lever assembly with a reversible handle that allows for pressure to be placed on the recoil spring and plug during the disassembly and assembly process. The tool also incorporate an alternate cutout in the handle which allows for a removable insert to be placed in the handle so as to allow for inserts of different types to accommodate differently shaped bushings made by a number of different manufacturers.

12 Claims, 7 Drawing Sheets

1911 HANDGUN BUSHING TOOL

CROSS REFERENCE TO RELATED APPLICATIONS

This is a continuation of Ser. No. 60/858,467, filed on Nov. 13, 2006.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

The present invention relates to a handgun tool, and more particularly, to a barrel bushing removal and installation tool for a semiautomatic handgun.

A semiautomatic handgun developed for the U.S. Army in 1911 is often referred to as a Model 1911. This handgun was extremely well designed to operate in adverse environments and fire with great accuracy projectiles having high kinetic energy at point of impact. Numerous variations have been developed over the years, both in details of construction and with calibers different from the initial 0.45 caliber bore.

One popular variant is known as the Model 1911-A1. This variant uses a single column magazine in which the rounds are stacked linearly on top of one another. A second variant is known as the Model 2011. This variant uses a staggered dual column magazine in which the rounds are stacked in a staggered fashion, linearly on top of one another.

The barrel bushing, located at the muzzle end of the slide is used to secure the barrel and recoil spring plug in place, provide a bearing travel surface for the barrel through the inner diameter of the bushing, and when rotated into the operating position, it secures the barrel, recoil spring and recoil spring plug into operating position for these handguns.

When the recoil spring, recoil spring plug and barrel are secured in place by the barrel bushing, the slide is now held in a closed position by the pressure of the recoil spring. When the barrel bushing is rotated in the clockwise direction, it allows the release of the recoil spring plug, recoil spring and barrel from the slide of the handgun. When the barrel bushing is rotated under spring pressure, caution must be observed as the recoil spring plug and spring may fly out of the slide causing injury or loss of the parts or both. This barrel bushing tool allows for the capture and trapping of the recoil spring and recoil spring plug during the disassembly and assembly process as is done during the cleaning cycle for this type of handgun. This capture and trapping process of the recoil spring and recoil spring plug by the bushing tool allows for the safe disassembly and assembly of the Model 1911, 1911-A1 and 2011 type of semi-automatic handguns. This barrel bushing tool also allows for a removable insert that can facilitate different manufacturers barrel bushing designs. This allows for the barrel bushing tool to be flexible in the use of barrel bushing designs and provide for a replacement insert when one wears out from time and use.

The present invention relates to a special type of handgun tool, and more particularly, to a leveraged barrel bushing removal and installation tool for a semiautomatic handgun.

Earlier and currently made barrel bushing tools or wrenches are made from flat stamped metal sheets or by polymer injection molding. They allow for the removal or replacement of the barrel bushing by rotation.

Previously constructed barrel bushing tools are normally made from a flat stamped out sheet of metal or by injection molding from plastics or polymers and do not incorporate a mechanism for safely trapping and capturing the recoil spring or recoil spring plug for disassembly or assembly.

Previously constructed barrel bushing tools or wrenches do not provide a flat surface large enough to protect the user from a flying recoil spring or recoil spring plug.

Previously constructed barrel bushing tools or wrenches do not have replaceable inserts for differently designed bushing.

Previously constructed barrel bushing tools do not have replaceable inserts to allow for wear and long term use.

Previously constructed barrel bushing tools were made of soft materials and easily broken.

Previously constructed barrel bushing tools were not manufactured to tight tolerances and in some cases did not fit the barrel bushing to allow for rotation.

BRIEF SUMMARY OF THE INVENTION

The primary object of this invention is to allow for the safe disassembly and assembly of the barrel bushing, recoil spring and recoil spring plug on a Model 1911, 1911-A1 or 2011 style semiautomatic handguns.

Another object of this invention is to provide for a barrel bushing tool that is exceptionally strong and with a handle length long enough to allow for good leverage when the tool is used by a gunsmith to size and fit new or existing bushings to the slide.

Yet another object of this barrel bushing tool is to provide the user with a hand held leverage mechanism where by the process of assembly and disassembly becomes easier and more ergonomically correct for the tool user.

A still further object of this invention is to provide the user with a selection of interchangeable inserts that will fit multiple barrel bushing manufacturer's designs.

Still another object of the invention is to provide a tool with an option for a removable insert so that different manufacturer's barrel bushing designs can be manufactured in the future to address new and continuing barrel bushing design changes or modifications.

Another object of the invention is to provide a tool that incorporates a mechanical method for the capture and trapping of the recoil spring and recoil spring plug.

Another object of the invention is to provide a tool that allows for the safe removal and installation of the barrel bushing, recoil spring and recoil spring plug.

A further object of the invention is to make an extremely efficient and fast operating tool which allows for more precise assembly and disassembly of the barrel bushing, recoil spring, and recoil spring plug than is currently known.

Another object of the invention is to provide a tool with an option for a removable insert to allow for replacement after prolonged use and wear.

Another object of the invention is to provide a tool that is constructed much stronger and more precise than any similar tool currently known.

A further object of the invention is to provide a tool that can be operated by both right and left handed personnel by simply reversing the lever handle on the tool.

Yet another object of the invention is to provide a tool that is meant for harsh environments and able to withstand extreme pressures without failure or breakage.

Other objects and advantages of the present invention will become apparent from the following descriptions, taken in connection with the accompanying drawings, wherein, by way of illustration and example, an embodiment of the present invention is disclosed.

In a U.S. Army Model 1911 and variant semiautomatic handguns, a barrel bushing is used to positively secure the barrel, recoil spring, recoil spring plug and create a spring induced pressure which allows the slide to move reward when the handgun is fired and return to the forward locked position during the firing operation cycle of the handgun, which in turn allows the spent brass to be ejected from the chamber and a new round to be drawn from the magazine and pushed into the chamber for firing.

In accordance with a preferred embodiment of the invention, there is disclosed: a tool for rotating the barrel bushing and capturing the recoil spring and recoil spring plug of a 1911 or 1911-A1 or 2011 model firearm comprising: an elongated handle having sides and ends and a slot for housing a lever assembly, a generally planar tool coupled to a lever and lever handle which allow pressure to be exerted to the recoil spring and recoil spring plug for removal and replacement of the barrel bushing and recoil spring plug, said tool having an upper end and opposite sides, with said tool defining an aperture corresponding to the shape of a barrel bushing and hole corresponding to the shape of a recoil spring plug, said tool with at least two sides with defining curves to provide a surface which is engaged by the user's hand, said tool having a simple lever system which is coupled to the tool body or "handle" via a stainless steel dowel rod, said tool having a stainless steel dowel rod for coupling and rotational purposes which is held in place via pressure exerted by a tapered hole, said tool with a flat cut on one side of the lever depressing plunger to allow space for different sized bushing faces, said tool having a curved cutout on the side of the lever, next to the plunger to allow for use with handguns having extended barrels.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
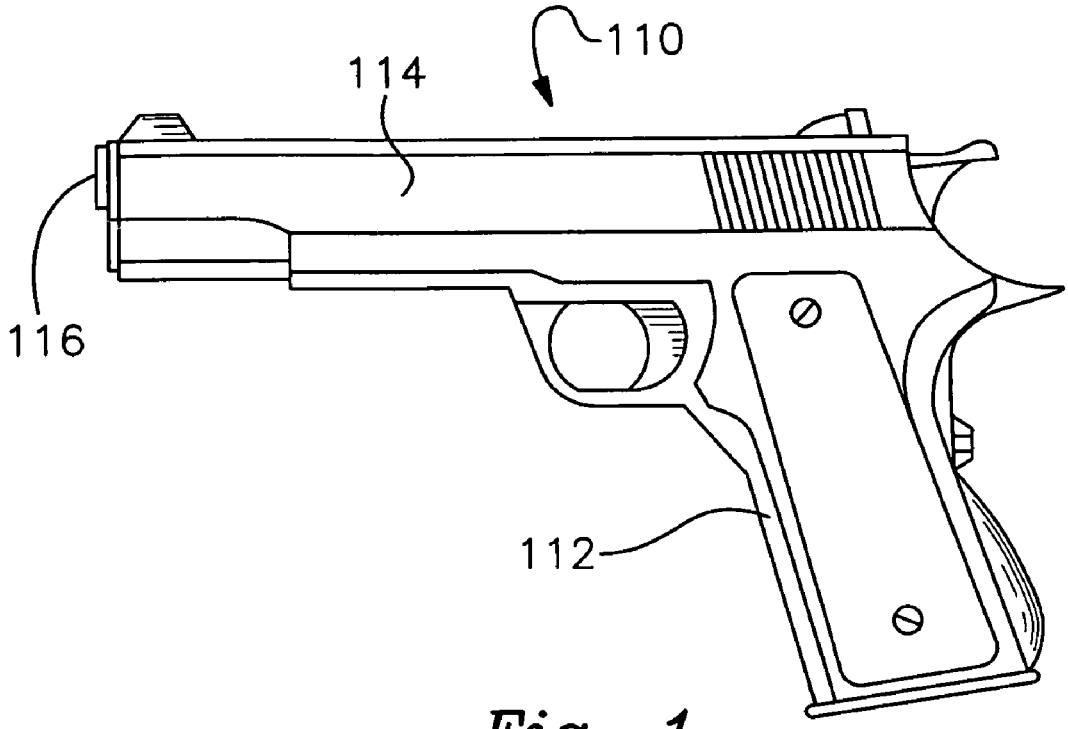
FIG. 1 is an elemental side and front view elevation of a prior art U.S. caliber 0.45 model 1911 semi-automatic pistol.
Figure 2:
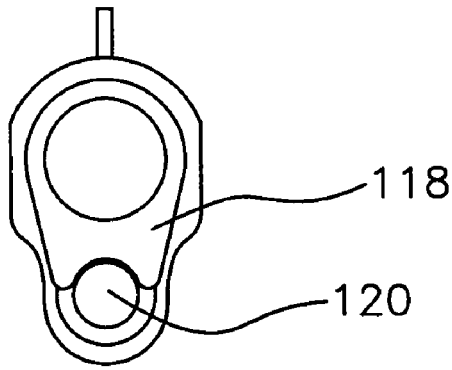
FIG. 2 is an elemental front view elevation of a prior art U.S. caliber 0.45 model 1911 semi-automatic pistol.
Figure 3:
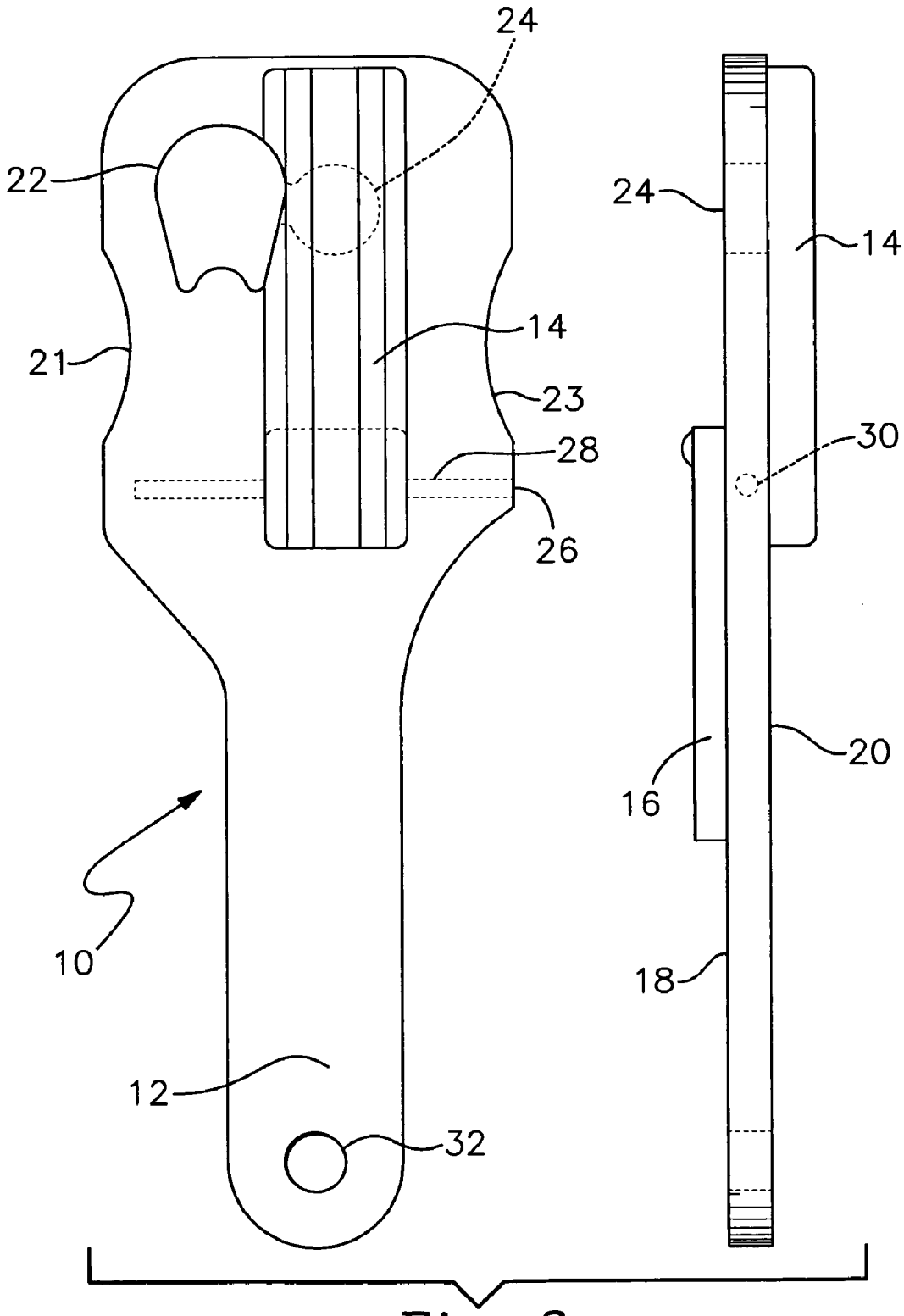
FIG. 3 is a detailed top view with rotated side view of the tool of the present invention showing the placement of the lever and handle.

Turning first to FIG. 1, there is shown an elemental side and front view elevation of a prior art U.S. caliber 0.45 model 911 semi-automatic firearm or pistol;

Turning to FIG. 2, there is shown an elemental front view elevation of a prior art U.S. caliber 0.45 model 1911 semi-automatic firearm or pistol with a standard rotating barrel bushing;

Next, turning to FIGS. 3 through 9;

FIG. 3 is a detailed top view with rotated side view of the tool of the present invention showing the placement of the lever and handle and comprising of a simple side view.

Figure 4:
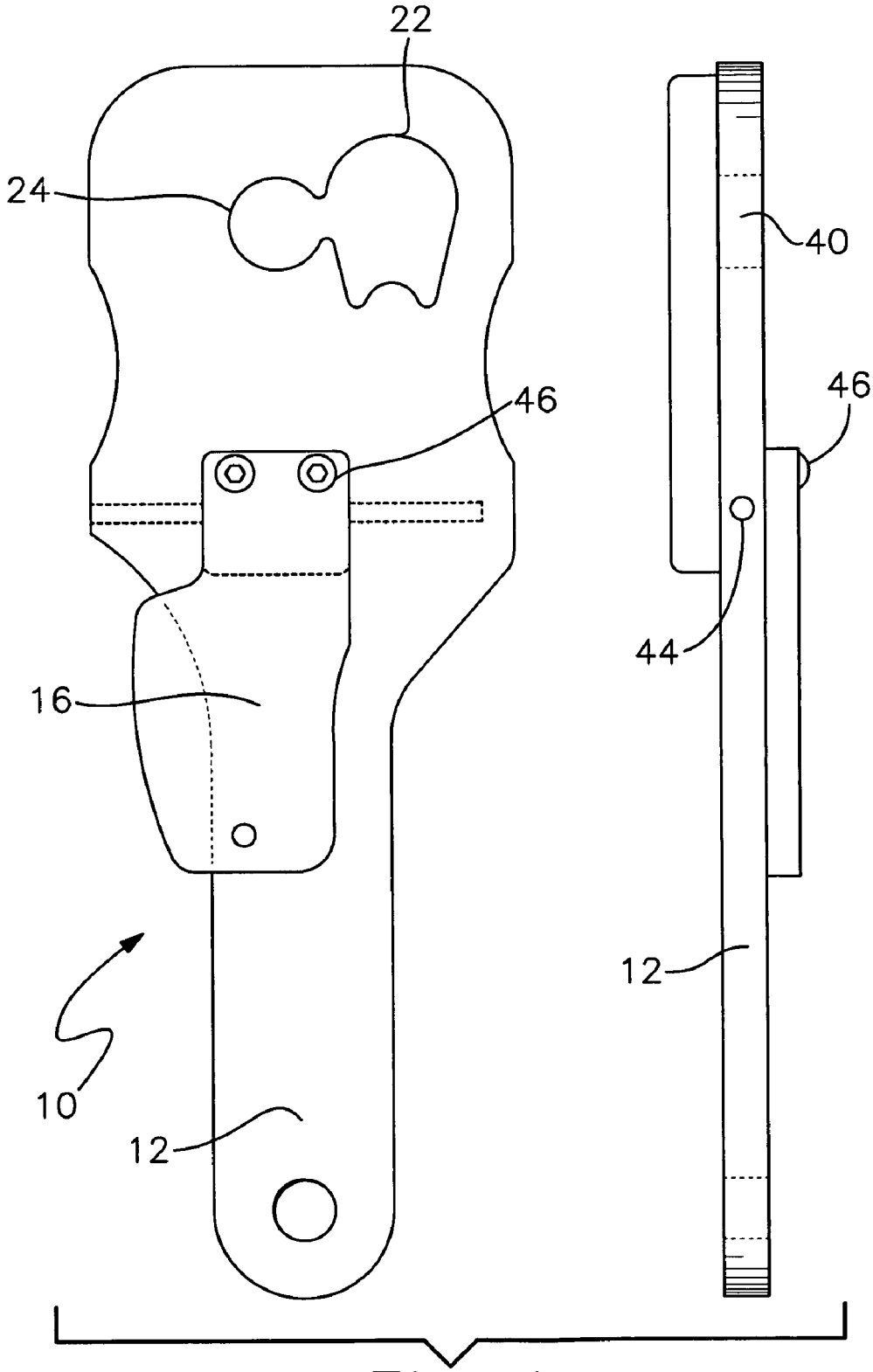
FIG. 4 is a detailed bottom view with rotated side view of the tool of the present invention showing the placement of the lever and handle.

FIG. 4 is a detailed bottom view with rotated side view of the tool of the present invention showing the placement of the lever and handle and coupling point via a stainless steel dowel rod in the handle.

Figure 5:
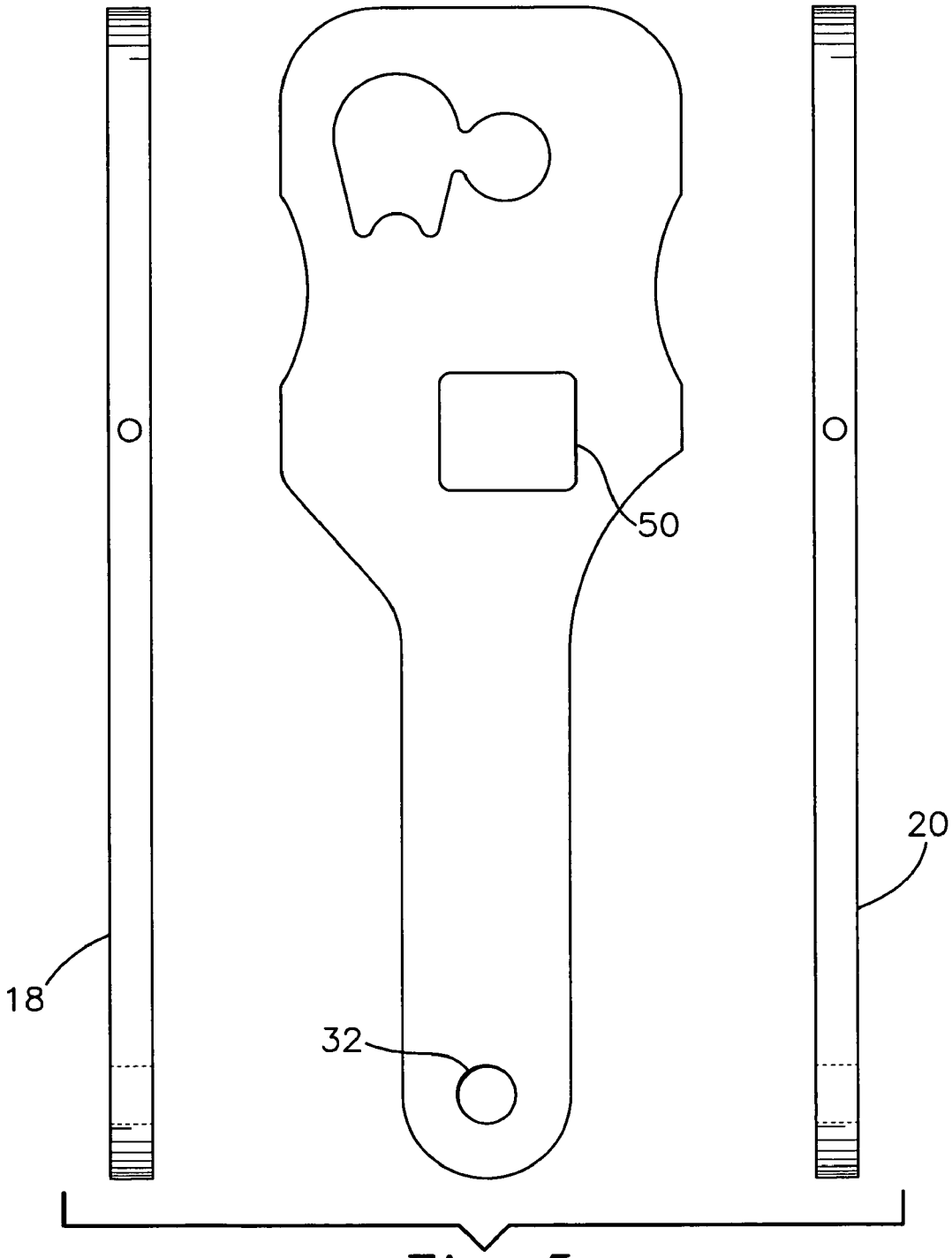
FIG. 5 is a detailed top view of the handle to include side views of the handle of the tool of the present invention.

FIG. 5 is a detailed top view of the handle to include side views, curves to fit user's hand during rotation and a round hanging hole for convenience drilled into the handle of the tool of the present invention.

Figure 6:
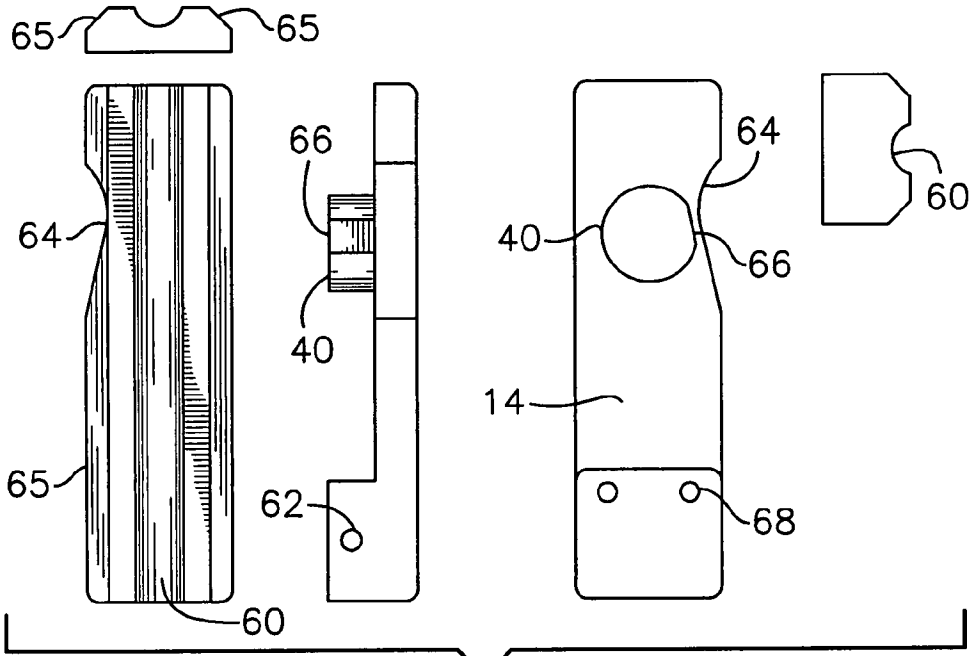
FIG. 6 is a detailed view of the lever of the tool of the present invention showing top, bottom, side and end views.

FIG. 6 is a detailed view of the lever assembly of the tool of the present invention showing top, bottom, side and end views; side cut out for extended barrels; top finger groove; flat on plunger to allow bushing clearance; 45 degree side chamfers; drilled and tapped holes for handle securing screws and the hole for the stainless steel dowel rod.

Figure 7:
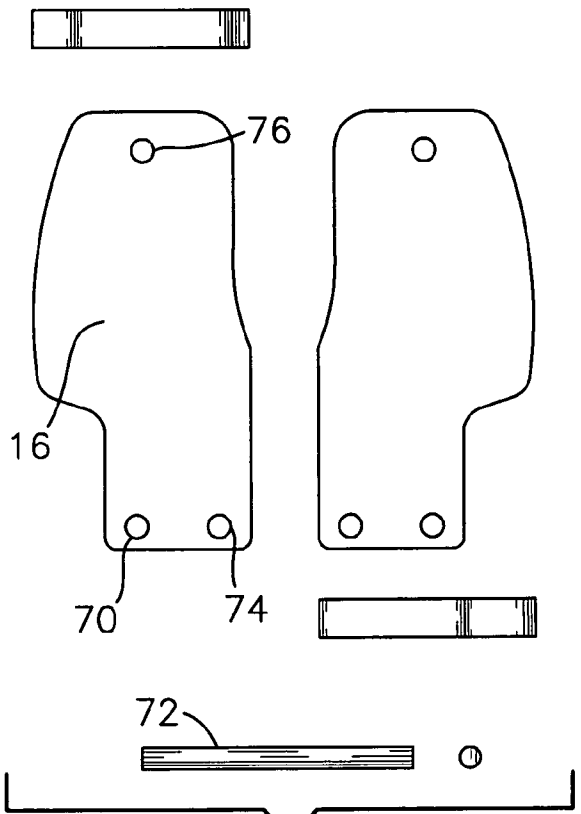
FIG. 7 is a detailed view of the lever handle of the tool of the present invention showing top, bottom, side and end views, with finger groove.

FIG. 7 is a detailed view of the reversible lever handle of the tool of the present invention showing top, bottom, side and end views, with two holes for securing screws to pass through and a single hole for location use during manufacturing process; also a front and side view of the stainless steel dowel rod.

Figure 8:
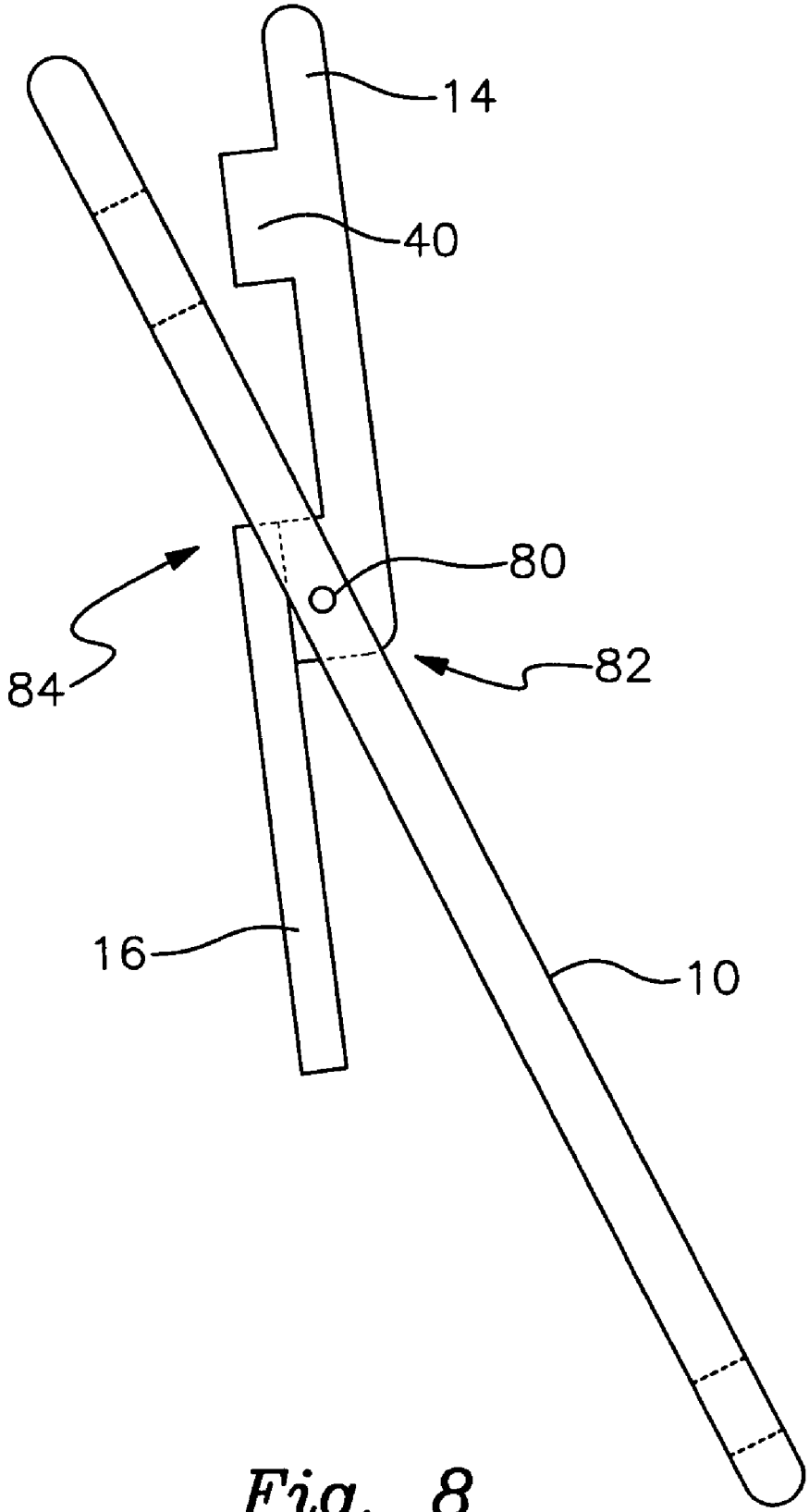
FIG. 8 is a detailed cross sectional view of the complete tool of the present invention showing how the lever and handle pivot for operation.

FIG. 8 is a detailed cross sectional view of the complete tool of the present invention showing how the lever and handle pivot for operation to allow for a user to apply leverage. It further shows the capturing hole that incorporates the safety mechanism that allows the tool to trap the recoil spring and recoil spring plug.

Figure 9:
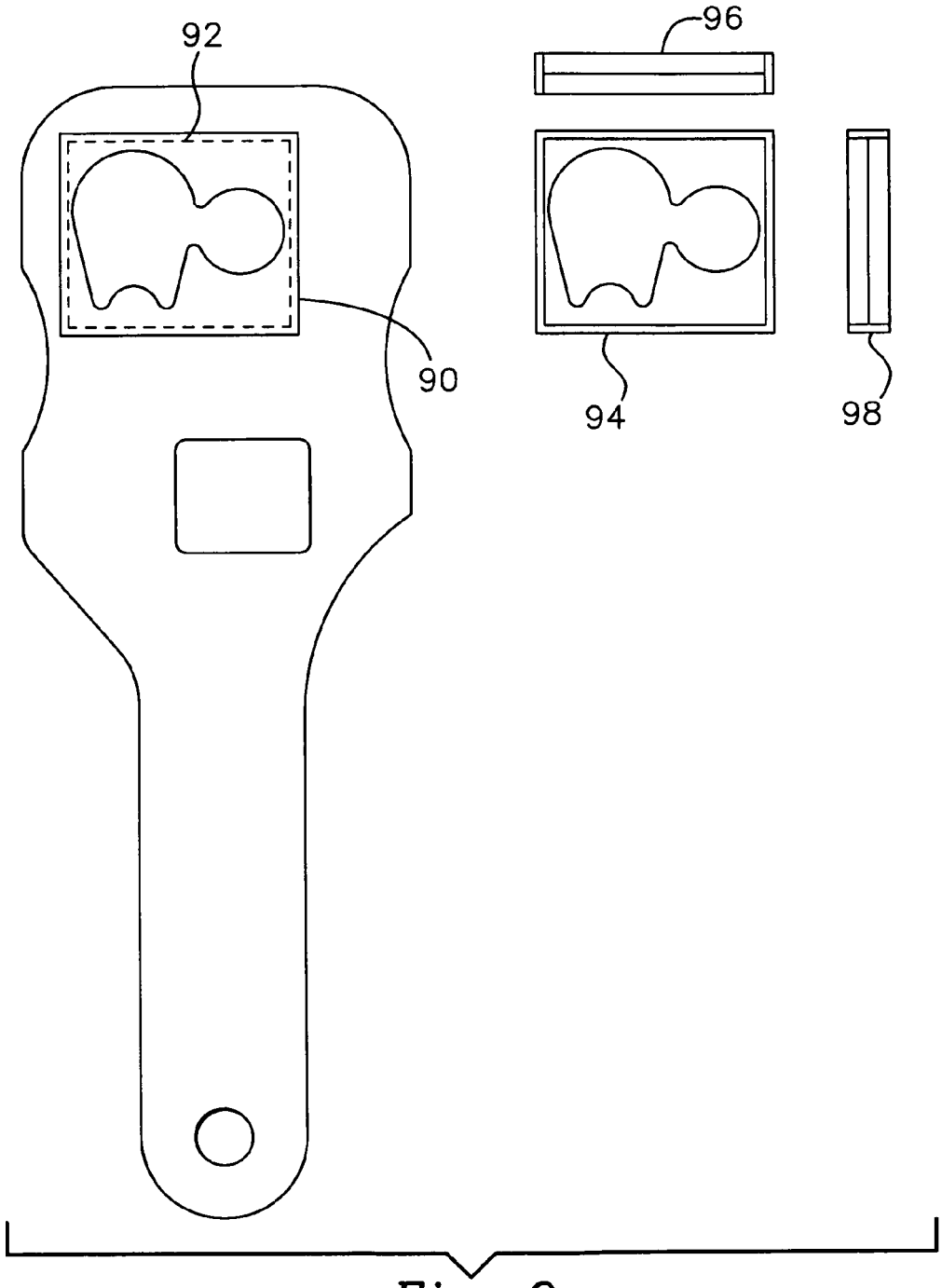
FIG. 9 is a detailed top view of the tool of the present invention showing the alternate removable non metallic insert with top and end views used to allow for barrel bushings of different sizes and configurations.

FIG. 9 is a detailed top view of the tool of the present invention showing the alternate removable metallic insert with top and end views used to allow for barrel bushings of different sizes and assorted manufacturer's configurations.

Referring now specifically to the drawings, a 45 caliber semi-automatic pistol of conventional manufacture is illustrated in FIGS. 1 and 2 and shown generally at reference numeral 110. Pistol 110 is broadly formed of a receiver 112, slide 114, barrel 116, barrel bushing 118 and recoil spring plug 120.

Referring now specifically to the tool drawings FIGS. 3-9, the tool of the present invention is generally designated by the FIG. 3, numeral 10 and includes an elongated handle 12, a lever assembly 14 and reversible lever handle 16 having opposite sections 18 and 20, an aperture cutout 22 corresponding to the shape of a barrel bushing, a hole 24 corresponding to the shape of a recoil spring plug, a hole 26 for the lever dowel, a rectangular cutout 28 for the lever assembly, a tapered hole 30 for the stainless steel dowel FIG. 7 numeral 72 and a tool hanging hole 32. The shape, of the tool handle is elongated with grooves on the sides 21, 23 for a secure user grip and with a finger groove 60 cut into the lever assembly 14 for added user pressure during the assembly or disassembly process of the 1911 style barrel bushings. Generally the reversible lever handle FIG. 4, 16 with plunger 40, is secured by machine screws 46 and the lever itself is secured via dowel hole 44 by a stainless steel dowel FIG. 7, 72. An internal taper FIG. 3, 28 within the tool dowel hole 26 retains the stainless steel dowel FIG. 7, 72 once the lever is installed into the tool handle. The lever, FIG. 6, 14 shows the finger groove 60, 45 degree slant cuts 65, extended barrel relief groove 64, flat cut for bushing clearance 66, dowel hole 62 and threaded securing screw holes 68 for the reversible lever handle 16. The reversible lever handle FIG. 7, 16 shows the reversible lever handle holes 70,74 for securing it to the lever 14 and a machining positioning hole 76 used during the construction process. The side sectional view of the tool of this invention, FIG. 8 shows the lever action of the tool 10, with lever 14, reversible lever handle 16 and plunger 40 pivoting at point 80 within slot 50's limits 82,84.

The handle section has a user friendly hanging hole 32, a slot 50 for the lever assembly 14, an aperture 22 simulating the shape of the barrel bushing and a hole 24 simulating the shape of a recoil spring plug. The handle section of the alternate tool FIG. 9 shows the removable insert slot 90 with snap in surface notch 92 and the removable barrel bushing insert 94 with top end view 96 and side end view 98. The handle of the alternate tool in FIG. 9 is exactly the same as the original tool of this invention 10 with the exception of the slot 92 cut in the tool handle to accommodate the removable barrel bushing insert 94.

In the preferred construction of this barrel bushing tool, it is quite important that the material of the handle, lever and lever handle should be constructed of aluminum aircraft alloy 6061-T6 and anodized for long wearing capabilities, but can be constructed of any suitable metal or plastic that will correspond to the stresses and characteristics that are similar in strength to aluminum aircraft alloy 6061-T6.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A 1911 Handgun Bushing Tool for rotating the barrel bushing, capturing and trapping the recoil spring and recoil spring plug of a 1911 or 1911-1 or 2011 model firearm comprising: an elongated handle having sides and ends and a slot for housing a lever assembly; a generally planar tool coupled to a lever and lever handle which allow pressure to be exerted to the recoil spring and recoil spring plug for removal and replacement of the bushing and recoil spring plug; said tool having an upper end and opposite sides, with said tool defining an aperture corresponding to the shape of a barrel bushing and hole corresponding to the shape of a recoil spring plug; said tool with at least two sides with defining curves to provide a surface which is easily engaged by the user's hand; said tool having a simple lever system which is coupled to the tool body or handle via a stainless steel dowel rod; said tool having a stainless steel dowel rod for coupling purposes which is held in place via pressure exerted by a tapered hole; said tool with a flat cut on one side of a lever depressing plunger to allow space for different sized bushing faces; said tool having a curved cutout on the side of the lever and plunger assembly to allow for handguns with extended barrels.

2. The tool of claim 1 wherein said tool includes a hanging hole at the bottom of the handle.

3. The tool of claim 1 wherein incorporates an improved safety mechanism to capture and trap the recoil spring and recoil spring plug during assembly and disassembly.

4. The tool of claim 1 wherein said aperture shape corresponds to the shape of a bushing of a 1911 style model firearm.

5. The tool of claim 1 wherein said round hole shape corresponds to the shape of a recoil spring plug of a 1911 style model firearm.

6. The tool of claim 1 can incorporate a removable insert in the handle to allow for different sized barrel bushings and subsequent new bushing designs and modifications.

7. The tool of claim 1 has a lever with a reversible handle for right and left hand users to allow for pressure to be exerted on the recoil spring and recoil spring plug prior to rotation of the barrel bushing during disassembly and assembly.

8. The tool of claim 1 has a finger groove running the length of the top of the lever assembly to allow for the user to apply added pressure to the lever assembly when needed.

9. The tool of claim 1 can use different aperture inserts to allow for a variety barrel bushing designs.

10. The tool of claim 1 has a pivoting lever pressure producing mechanism via a reversible lever and handle assembly.

11. The tool of claim 1 provides for the use of a stainless steel dowel rod which is used as a pivot point and securing system for the entire lever and handle assembly.

12. The tool of claim 1 allows the user to apply leveraged pressure to the plunger which is transmitted to the recoil spring and recoil spring plug via a reversible handle.

* * * * *